US005375646A

United States Patent [19]

Stummer et al.

[11] Patent Number: 5,375,646

[45] Date of Patent: Dec. 27, 1994

[54] METHOD OF CONTROLLING CASTING PARAMETERS IN A DIECASTING MACHINE

[75] Inventors: Friedrich Stummer, Fellbach; Wolfgang Lutz, Kernen, both of Germany

[73] Assignee: Maschinenfabrik Mueller-Weingarten AG, Weingarten, Germany

[21] Appl. No.: 119,101

[22] PCT Filed: Apr. 1, 1992

[86] PCT No.: PCT/DE92/00266

§ 371 Date: Sep. 15, 1993

§ 102(e) Date: Sep. 15, 1993

[87] PCT Pub. No.: WO92/18274

PCT Pub. Date: Oct. 29, 1992

[30] Foreign Application Priority Data

Apr. 19, 1991 [DE] Germany ..... 4112753

[51] Int. Cl.[5] ..... B22D 17/32

[52] U.S. Cl. ..... 164/457; 164/113; 164/155.2

[58] Field of Search ..... 164/4.1, 457, 150, 154, 164/155, 113

[56] References Cited

FOREIGN PATENT DOCUMENTS

| | | | |
|---|---|---|---|
| 2307846 | 8/1974 | Germany . | |
| 2548750 | 5/1976 | Germany . | |
| 2834577 | 2/1980 | Germany . | |
| 2931199 | 2/1981 | Germany . | |
| 3221708 | 2/1984 | Germany . | |
| 3344537 | 6/1985 | Germany . | |
| 8422336 | 12/1985 | Germany . | |
| 3505554 | 8/1986 | Germany | 164/457 |
| 3636936 | 5/1988 | Germany | 164/155 |
| 60-99471 | 6/1985 | Japan | 164/155 |
| 1-154858 | 6/1989 | Japan | 164/457 |
| 219123 | 8/1968 | U.S.S.R. | 164/155 |
| 1435388 | 11/1988 | U.S.S.R. | 164/457 |

OTHER PUBLICATIONS

"Elektrotechnik" vol. 66, No. 13–, Jul. 6th, 1984, Wuerzburg, pp. 26–31; Krueger G., Bressner W.: "Mit optischem Sensor und Mikrorechner".

"Praxis der Druckgussfertigung" (Practice of die-casting production); by Ernst Brunhuber; 3rd edition, 1980, pp. 82–91 and 104–111.

*Primary Examiner*—J. Reed Batten, Jr.

*Attorney, Agent, or Firm*—Spencer, Frank & Schneider

[57] ABSTRACT

Casting parameters in at least one of a feeding and mold-filling and squeezing phase are controlled during a casting step in a cold-chamber die-casting machine. The casting parameters are controllable as a function of travel of a casting piston longitudinally displaceable in a shot sleeve. The quantity of molten metal filled in within the shot sleeve is determined by precise metering using a stationary optical measuring device. The metering is accomplished by beaming a measuring beam through a filling port of the shot sleeve and reflecting the measuring beam on a surface of the molten metal. The transit time of the measuring beam and the reflected beam are measured to determine a filling level and quantity of molten metal filled in. A control system is provided which controls a movement of the casting piston and a start of each phase as a function of the filling level and the associated quantity of molten metal filled in.

9 Claims, 2 Drawing Sheets

METHOD OF CONTROLLING CASTING PARAMETERS IN A DIECASTING MACHINE

BACKGROUND OF THE INVENTION

The invention relates to a method of controlling casting parameters in a die-casting machine. The casting parameters are controllable as a function of travel of a casting piston longitudinally displaceable in a shot sleeve.

1. State of the Art

Automatic control of die-casting machines is known from the literature reference Ernst Brunhuber: "Praxis der Druckguβfertigung [Practice of die-casting production]", 3rd edition, 1980, pages 82 et seq. According to pages 84 and 85 of this literature reference, a distinction is made between feeding phase, mold-filling phase and squeezing phase, the piston stroke of the casting piston and hence the molten metal in the shot sleeve being controlled in each phase. The quantity filled into the shot sleeve here plays a decisive role, since, for example, the start of the mold-filling phase is dependent on the quantity filled in and on the position of the casting piston.

2. The Metering of the Molten Metal is Carried Out as Follows:

In cold-chamber die-casting machines, the casting metal is taken from a holding furnace and filled into the shot sleeve of the casting unit. In manual operation, this is done by ladling the molten metal with a ladle from the holding furnace and emptying it into the filling port of the shot sleeve. Metering and charging devices have also been disclosed, by means of which the step of filling the shot sleeve with molten metal can be automated. In Brunhuber (loc. cit.), pages 105 to 110, a device is described which uses a meter ladle which dips into the holding melt, takes up an appropriate quantity of measured metal and empties the latter into the filling port, after transporting to the shot sleeve. The ladle is adjustable in such a way that it allows precise metering of the desired quantity of metal. Excess metal then flows back into the holding furnace when the ladle is moved up. The metering accuracy is indicated for a particular unit at +/−0.8% in the metering range from 0.1 to 15 kg of aluminum alloy.

In cold-chamber die-casting processes, the quality of the castings is determined by a multiplicity of process parameters. The accuracy of metering the molten metal here affects the casting quality to a high degree, and it is possible for adverse influences to affect the total casting process in the direction of an inadvertent and disadvantageous shifting of the starting points of the casting phases, of a change of the casting piston speed and of the casting pressure.

For achieving a high metering accuracy in die-casting machines, it has been disclosed by DE 84 22,336 U1 to detect the level in the die-casting mold by means of a contact pin, wherein the molten metal rising in the casting mold short-circuits two contacts and this then makes a signal. This measured signal can then be fed to a regulating or control unit and utilized for automatic control.

Also known is the use of sensors which are designed as a thermocouple and which record the temperature of the melt at a defined level.

The fitting of such sensors in the casting chamber itself frequently leads to unreliable results, since these are considerably stressed due to the high temperatures and the rough handling in the casting chamber, so that it is hardly possible to set accurate and reproducible values.

Furthermore, a wave-like or sloshing motion of the melt frequently occurs in the shot sleeve and, due to different melt levels, this can indicate false filling values. The signal emitted accordingly corresponds not to the filling level actually present. The consequence can therefore be a corresponding maloperation of the control.

Moreover, DE 3,344,537 C1 has disclosed a method of timed metering of a quantity of molten metal in die-casting. In this method, a defined measured quantity of metal is fed to the shot sleeve via a riser from a furnace by a defined compressed-air surge from a constant pressure wave. This method requires a large expense on apparatus and continual compensation of the metering time as a function of the furnace filling and of the length of the slug on the work piece. Control of the motion of the casting piston is not provided thereby.

Furthermore, DE 2,307,846 A1 has disclosed a method for automatic take-up of molten metal, wherein the metering of the quantity of melt is effected via a weight measurement. The precise level is detected via a combined pressurization of the holding furnace and a measurement of the weight of both the casting quantity released from the holding furnace and taken up by the casting mold. Additional scanning of the casting riser or directly of the casting mold during the casting step via a photoelectric cell directed upon the casting mold is here provided, and this is connected to a control system. The casting step is then monitored via the photoelectric cell (infrared eye). After a set value has been reached, for example in the casting mold, a valve is to be opened, for example in the pressure line. This causes a sharp fall in pressure, so that sloshing-over of the molten metal is avoided.

This arrangement also relates to automatic metering of molten metal in the mass production of castings. It does not relate to any control of the casting parameters as a function of the molten metal in a shot sleeve of a cold-chamber die-casting machine.

SUMMARY OF THE INVENTION

The method according to the invention includes controlling the casting parameters as a function of travel of a casting piston longitudinally displaceable in a shot sleeve. The quantity of molten metal filled in within the shot sleeve is determined by precise metering using a stationary optical measuring device. The metering is accomplished by beaming a measuring beam through a filling port of the shot sleeve and reflecting the measuring beam on a surface of the molten metal. The transit time of the measuring beam and the reflected beam are measured to determine a filling level and quantity of molten metal filled in. A control system is provided which controls a movement of the casting piston and a start of each phase as a function of the filling level and the associated quantity of molten metal filled in. This method has the advantage over the known methods or devices that a control of the casting parameters as a function of the filling level in the shot sleeve is created, a precise device for metering and charging molten metal into the shot sleeve of a die-casting machine being provided. By means of this, the level in the shot sleeve and hence the quantity of melt can be determined very accurately. The precise level allows the so-called machine data to be determined exactly. These are in particular the reaction and calculation times of the regulation or control and the remaining working times of the hydraulic components. By this means, the starting points of the changes in the casting piston speed during individual phases of the casting piston and the associated casting pressure can be determined and controlled with extreme precision. The exact feeding phase or the exact feeding stroke of the casting piston within the shot sleeve up to the state of complete filling of the "remaining shot sleeve" and hence the start of the mold-filling phase can thereby be determined exactly. This is possible only because the quantity filled into the chamber volume of the shot sleeve can be determined with high accuracy. As a result, the course in time of the feeding phase, mold-filling phase and squeezing phase can be determined and controlled exactly, which leads to an improvement in the quality of the castings.

The very precise determination of the level of molten metal in the shot sleeve conversely also allows a very accurate metering and charging step, since this can be controlled on the basis of the level measurement. If the most accurate level values of the melt in the shot sleeve are available, the casting parameters can be very accurately calculated and controlled. Examples of these casting parameters are the initiation of quantity-dependent positions of the casting piston in the feeding phase and especially the control of the speed of the casting piston. Furthermore, a quantity-dependent initiation of the position of the casting piston in the mold-filling phase or the initiation of the mold-filling phase can be initiated in this way, speeds of the casting piston and damping phenomena, for example, again being detectable. Finally, very accurate metering and hence exact knowledge of the quantity of melt can effect a most precise initiation of the squeezing phase.

In the following description of an illustrative embodiment of the method according to the invention, further details and advantages of the invention are more particularly explained.

DETAILED DESCRIPTION OF THE PREFERRED EMBODIMENT

Figure 1:
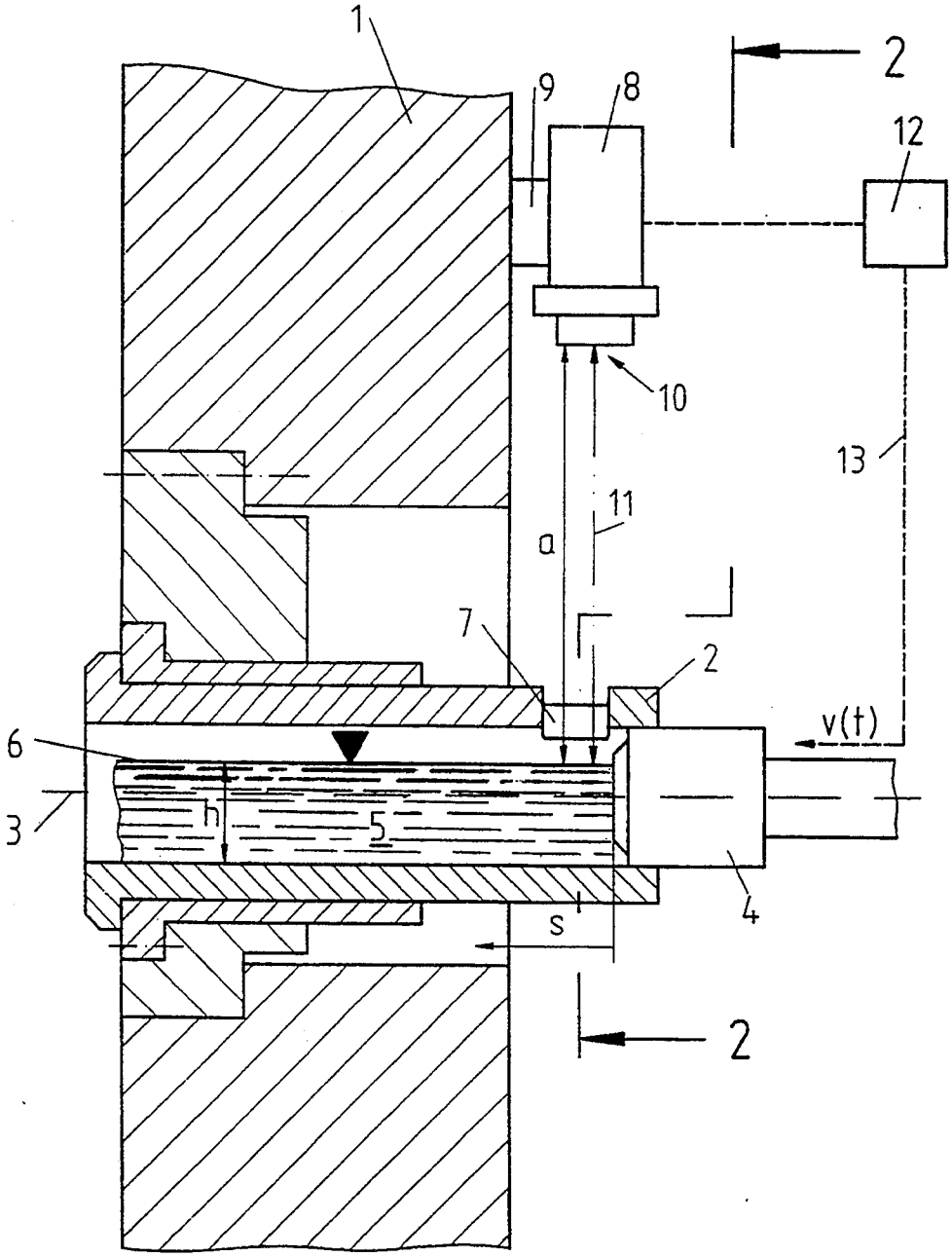
FIG. 1 shows a diagrammatic illustration of a shot sleeve in a fixed mounting platen of a die-casting machine with a measuring and control device according to the invention for carrying out the method according to the invention.
Figure 2:
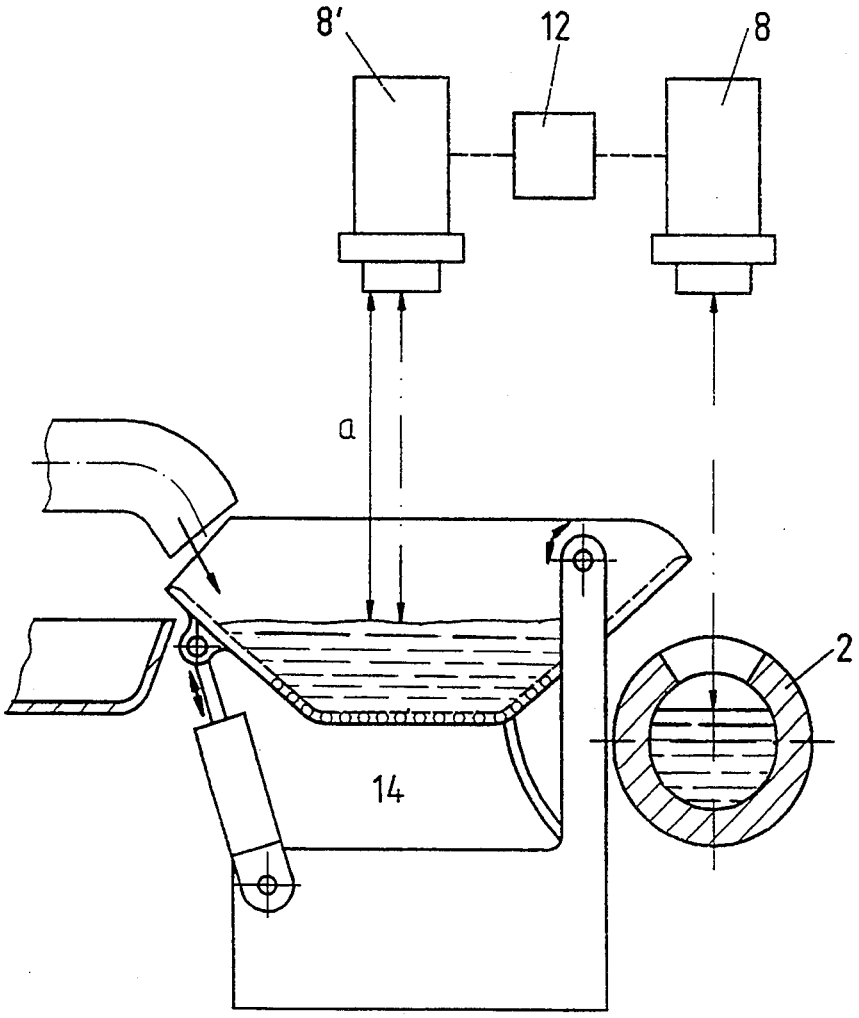
FIG. 2 is a partial sectional view taken along A—A of FIG. 1, and illustrating a meter ladle.

The method according to the invention is explained in more detail by reference to the illustrations in the figures, as follows:

Referring to FIGS. 1 and 2, in a cold-chamber die-casting machine not shown in more detail, there is, in the fixed mounting platen 1, a shot sleeve 2 with a horizontal longitudinal axis 3 of the shot sleeve. A casting piston 4 moves in the shot sleeve 2 from the right to the left in the figure and forces the molten metal 5, filled into the shot sleeve, with the melt surface or the melt level 6, in the direction of the casting mold not shown in more detail (travel "s"). The molten metal 5 is introduced into the shot sleeve through the top filling port 7, for example by means of a meter ladle described at the outset.

As described at the outset, the metering accuracy, with which the molten metal can be fed to the shot sleeve, is of the order of magnitude of +/−1%. This metering accuracy can only be achieved with great expense in the case of appropriate meter ladles. Usually, only +/−2% metering accuracy is achieved at tolerable cost.

The degree of filling of the shot sleeve can vary considerably depending on the application. As shown in the figure, it is frequently more than 50% of the chamber volume, i.e. the melt level 6 is a little above the longitudinal axis 3 of the shot sleeve. During the so-called feeding phase, the shot sleeve volume is reduced by the slow feeding stroke of the casting piston until the liquid level 6 of the molten metal reaches the uppermost rim of the shot sleeve, i.e. the "remaining volume" of the shot sleeve is completely filled with molten metal. It is only after this point in time that the actual mold-filling phase for filling the casting mold starts. The time when this point is reached results exclusively from the quantity of molten metal filled into the shot sleeve. If, for example, only 50% of the shot sleeve is filled, the casting piston must cover about 50% of its feeding stroke in order to fill the shot sleeve completely. If more than 50% of the shot sleeve is filled, the feeding stroke is already complete after less than 50% of the total stroke.

The quantity of the molten metal filled into the shot sleeve also determines the speed of the casting piston, which is to be set in order to obtain uniform rising of the molten metal without inclusions of air, as far as possible. The precise level and the determination of the precise quantity thus fix the precise point in time of the completion of the prefilling phase and the start of the mold-filling phase.

In order to detect the precise metering quantity and hence the precise level of the quantity of melt in the shot sleeve, the invention provides a stationary measuring device 8 which is rigidly joined to the mounting platen 1 via a bridge 9. By means of this measuring device, the level 6 of the melt in the shot sleeve can be determined by means of ultrasonics or a laser spatially above the shot sleeve 2. The measuring device 8, 8' with the measuring eye 10 is here installed at a distance a away from the filling port 7 of the shot sleeve 2, so that it is protected against heat or other damage. Moreover, this allows unhindered access to the filling port 7, for example by a casting ladle 14. Finally, an elimination of interfering parameters such as screens and the like in the region of the shot sleeve is possible.

The measurement of the filling level or else the degree of filling 6 of melt 5 in the casting chamber 2 by the measuring device 8 with an incorporated sensor takes place continuously or discontinuously by means of an ultrasonic beam or laser beam 11 as the measuring beam 11, which is reflected at the surface 6 of the melt and received again as reflected beam. The transit time of the measuring beam is here a measure of the filling level h in the shot sleeve 2. In a computer 12, shown diagrammatically, the transit time of the measuring beam or reflected beam is transformed into a distance signal which indicates the filling level. The computer 12 controls the movement of the casting piston via the line 13.

By means of the filling level h or melt level 6 in the shot sleeve 2, determined in this way, a number of control actions can be carried out during the casting step. On the one hand, the step of filling with molten metal can be monitored directly by continuous measurement, it being possible for the desired filling quantity to be limited after the desired level has been reached. The wave motion, which arises within the shot sleeve during the filling with melt, can be compensated by averaging the wave crest and wave trough. In this way, even widely fluctuating melt levels 6 can be averaged by computation, and the actual level can thus be determined. Only a completely exact determination of the quantity filled in ensures that the casting parameters to be subsequently set are correct.

The measurement of the level of the melt in the shot sleeve can also be carried out after the shot sleeve has been filled. In this case, the quantity in the shot sleeve is predetermined by the level 6 which has been reached, so that the casting parameters must be adjusted thereto. In particular, these are the motion sequence of the casting piston 4 and the feeding stroke of the casting piston 4 into the shot sleeve up to the point when the melt completely fills the entire shot sleeve, i.e. extends up to the upper margin of the shot sleeve. It is only after this precise point in time that the subsequent mold-filling phase starts. The initiation of the mold-filling phase is therefore dependent on the quantity of melt and hence also on the exact position of the casting piston 4 in the shot sleeve. The feeding phase, i.e. the phase during which the casting piston 4 compresses the molten metal filled into the shot sleeve 2 up to complete filling thereof, is also decisively influenced in its course and its speed by the filling level. Finally, the initiation of the third phase, i.e. the squeezing phase, is also decisively determined by the quantity of melt present, so that the precise point in time again is dependent on the quantity filled in.

A device for continuous contactless level measurement in containers with liquids is known in principle. In such a measuring device, a sensor emits ultrasonic pulses at a frequency of about 46 kHz. The sonic waves are reflected by the surface of the liquid and received again by the sensor. The sound transit time which elapses between the emission and reception of the sonic pulse is evaluated electronically and passed on as a signal, proportional to the filling level, to the connected instruments. The distance a from the measuring probe 10 to the maximum level is stated to be of the order of magnitude of a $\approx$45 to 70 cm. However, other distances can also be set.

The invention is not restricted to the last described illustrative embodiment of the method. Rather, it also comprises all further developments and embodiments by those skilled in the art, within the scope of the core idea according to the invention.

We claim:

1. A method of controlling casting parameters in at least one of a feeding phase and mold-filling phase and squeezing phase during a casting step in a cold-chamber die-casting machine, the casting parameters being controllable as a function of travel of a casting piston longitudinally displaceable in a shot sleeve, comprising the steps of:

A. precisely metering and determining a quantity of molten metal filled in within the shot sleeve using a stationary optical measuring device;

B. performing said metering step by the steps of:

beaming a measuring beam through a filling port of the shot sleeve;

reflecting the measuring beam on a surface of the molten metal; and measuring a transit time of the measuring beam and the reflected beam to determine a filling level and quantity of molten metal filled in; and C. providing a control system which controls a movement of the casting piston and a start of each phase as a function of the filling level and the associated quantity of molten metal filled in.

2. The method as claimed in claim 1, wherein said metering step occurs in conjunction with a feeding of the molten metal, further metering of the molten metal occurring in dependence on the filling level.

3. The method as claimed in claim 1, further comprising the step of positioning the casting piston within the shot sleeve at a start of the mold-filling phase so that a remaining volume of the shot sleeve is filled to a predetermined extent with the molten metal.

4. The method as claimed in claim 1, further comprising the steps of detecting a wave motion of the surface of the molten metal during a filling of the shot sleeve with the molten metal; averaging the measured level values; and compensating for variations.

5. The method as claimed in claim 1, further comprising the step of supplementing the measurement of the level in the shot sleeve by a preceding measurement of a level in a meter ladle.

6. The method as claimed in claim 5, wherein said supplementing step includes controlling a pouring motion from the meter ladle as a function of the measured level in the meter ladle.

7. The method as claimed in claim 1, further comprising the steps of controlling the casting parameters in the feeding phase and initiating quantity dependent positions of the casting piston in the shot sleeve during the feeding phase in dependence on the measured quantity of molten metal filled into the shot sleeve.

8. The method as claimed in claim 1, further comprising the steps of controlling the casting parameters in the mold-filling phase and initiating quantity-dependent positions of the casting piston in the mold-filling phase in dependence on the measured quantity of molten metal filled into the shot sleeve.

9. The method as claimed in claim 1, further comprising the steps of controlling the casting parameters in the squeezing phase and initiating the squeezing phase during the casting step in dependence on the measured level of molten metal filled into the shot sleeve.

* * * * *